United States Patent [19]

Carroll et al.

[11] Patent Number: 4,723,680

[45] Date of Patent: Feb. 9, 1988

[54] UTILITY BIN

[76] Inventors: Floyd E. Carroll, Rte. 1, Box 96, Notasulga, Ala. 36866; Rodger L. Carroll, P. O. Box 4, Evergreen, Ala. 36401

[21] Appl. No.: 802,320

[22] Filed: Nov. 27, 1985

[51] Int. Cl.[4] ..... A47B 46/00; B65D 25/24

[52] U.S. Cl. ..... 220/18; 220/22.1; 312/246; 312/248

[58] Field of Search ..... 220/18, 22.1, 22.2, 220/22.4, 22.5; 312/245, 246, 247, 248

[56] References Cited

U.S. PATENT DOCUMENTS

| | | | |
|---|---|---|---|
| 456,465 | 12/1891 | Doan | 220/22.4 |
| 1,441,410 | 9/1923 | Eustis | 220/18 |
| 1,931,891 | 10/1933 | Cooper | 220/22.2 |
| 2,062,793 | 12/1936 | Nicol | 220/18 |
| 2,459,301 | 1/1949 | Adams | 220/18 |
| 3,722,974 | 3/1973 | Deeds | 312/248 |
| 4,026,434 | 5/1977 | Howard | 220/18 |
| 4,076,351 | 2/1978 | Wyant | 312/247 |
| 4,258,557 | 8/1981 | Paladino | 312/248 |
| 4,570,812 | 2/1986 | Curtis | 220/18 |

FOREIGN PATENT DOCUMENTS

| | | | |
|---|---|---|---|
| 333104 | 11/1903 | France | 220/18 |
| 626228 | 11/1961 | Italy | 220/22.5 |
| 57673 | 3/1937 | Norway | 220/18 |

*Primary Examiner*—George E. Lowrance

*Attorney, Agent, or Firm*—Michael C. Smith

[57] ABSTRACT

A utility bin for enclosure in structures such as furniture, cabinets, and closets for storage of such objects as magazines, newspapers, books, wearing apparel and linen. As storage for wearing apparel and linen, forward and rear pivot arms on each end of the bin control the movement of both the upper and the lower area of the bin outward to a tilted position. As storage for magazines, newspapers, and books, the bin also has an automatically positioned panel for support of upright placed contents. Rollers attached to the support panel contact a downward sloping rear to front surface such as the bottom to effect movement forward for contact with the contents of the bin when the bin is placed in home position. Flexible retainers such as chains attached to the rear of the support panel and to the rear of the enclosure structure retain the upright support panel to the rear when the bin is moved outward allowing unobstructed access to the contents of the bin.

4 Claims, 13 Drawing Figures

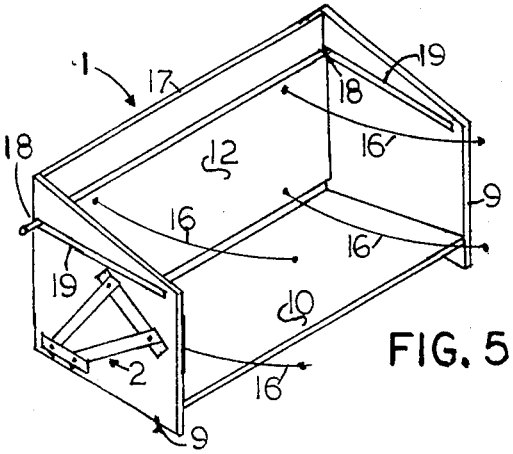
FIG. 5
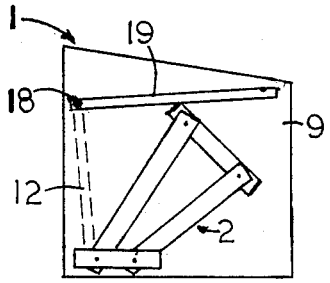
FIG. 6
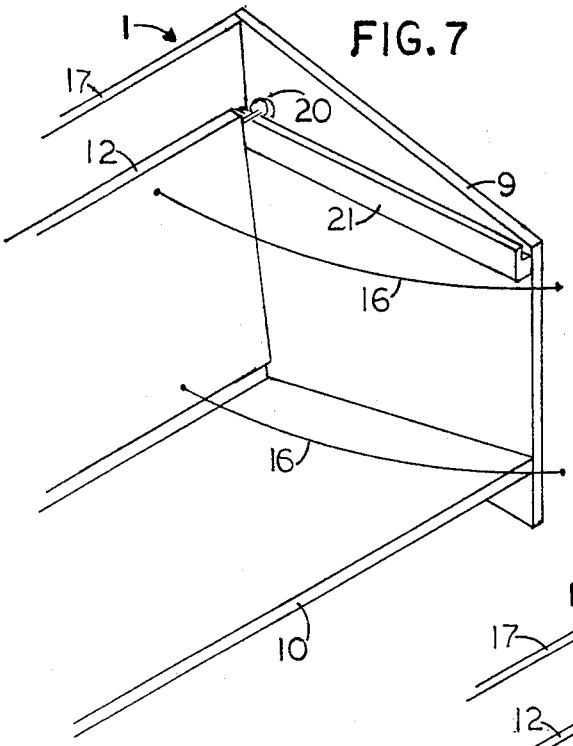
FIG. 7
FIG. 8
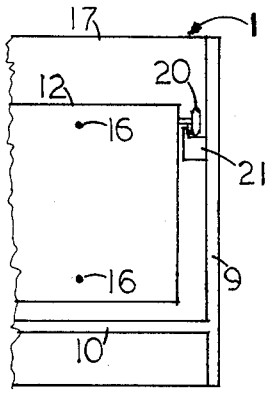
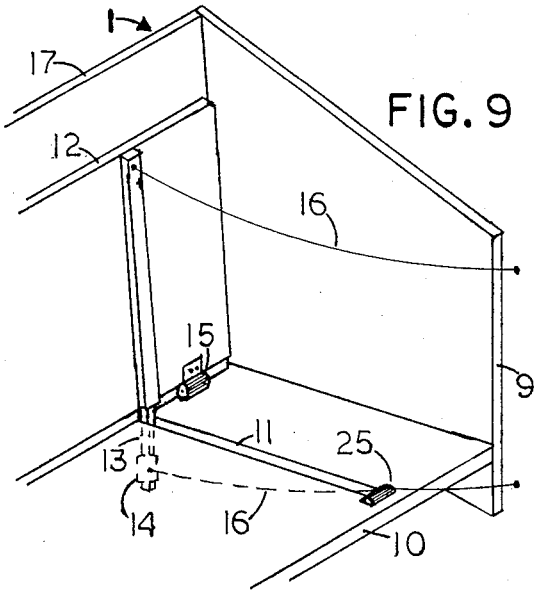
FIG. 9

UTILITY BIN

BACKGROUND OF THE INVENTION

1. Field of the Invention

The present invention relates to such storage means for common objects of everyday use as articles of furniture, cabinets, and closets. At the present time, the general means of storage for such objects as magazines, newspapers, books, papers, wearing apparel, and linen includes pull out drawers which slide or roll on some type of track, a tilt out dirty clothes bin hinged to pivot at the bottom with only the top portion moving outward significantly, cabinets and closets with shelves accessed by swinging or sliding doors, and floor standing and wall hanging racks and shelves of various types which leave stored objects exposed to view.

The present invention provides quicker, more convenient out of the way storage for such said objects and provides more convenient access to each stored object.

2. Description of the Prior Art

An existing tilt out bin sometimes used in conjunction with bathroom vanities or closets for temporary storage of dirty clothes is restricted in practical depth to height ratio by being pivoted at the bottom by means of existing hinges, allowing only the top portion of this bin to move outward significantly. This restricted positioning renders this type of bin impractical as a means for storing heavier objects.

The present invention overcomes these limitations by incorporating a pivot means which positions the bottom portion as well as the top portion of the Utility Bin significantly outward, diminishing depth to height ratio restrictions and maintaining ease of operation with heavier stored objects by more suitably distributing the weight of the contents as the Utility Bin is moved among access, home, and intermediate positions.

Several configurations of hinges exist which function to maintain a door or lid at certain points along the path of swing, but none of these hinges is capable of being employed in the method described for the present invention.

No existing means can meet the requirement of moving both the upper and the lower portions of a bin outward smoothly several inches in a single operation that would not require that the pivot means be extended several inches or more below the main body of the bin or else cause a severe initial lifting or lowering of the bin as it is moved outward that would make it impractical for use in an enclosed or surrounding structure such as furniture, cabinets, and closets.

SUMMARY OF THE INVENTION

This invention is a Utility Bin, an object of which is to provide quicker, more conveniently accessible, easier to operate out of the way storage for common objects of everyday use, being easily operated smoothly with one hand, in contrast to such existing storage means as large drawers which often stick or bind.

The Utilit Bin is designed for employment within the structure of such articles as furnture, cabinets, and closets.

The Utility Bin, configured as means of storage for such objects as wearing apparel and linen, comprises a pivot means to effect the movement, in a single smooth operation, of the lower portion of the bin several inches outward beyond the said housing structure, and at the same time the upper portion of the bin several inches farther outward beyond the lower portion of the bin, said pivot means being means of providing more ease of access, ease of operation, and also enhanced versatility of the Utility Bin than could be provided by existing pivot means such as existing hinges.

The Utility Bin, configured as means of storage for such objects as magazines, newspapers, and books also comprises an automatically positioned upright support panel to maintain such said objects in an upright position when the bin is in home position, with flexible retainers to retain the support panel to the rear when the bin is in access position. The automatic positioning of the support panel decreases the restriction of the dimensions of and the placement of said stored objects that is inherent in any fixed upright support means such as partitions or end slots, and eliminates obstruction to access of said objects while requiring no handling of said support panel by the user.

BRIEF DESCRIPTION OF THE DRAWINGS

Other objects and advantages of the invention will become more apparent from the specification taken in conjunction with the accompanying drawings, in which:

FIG. 5 is a perspective rear view of the Utility Bin in home position illustrating a first alternative configuration of the upright support panel.

FIG. 6 is an end view of the Utility Bin illustrating the said first alternative configuration of the upright support panel.

FIG. 7 is a perspective rear view of the Utility Bin in home position illustrating a second alternative configuration of the upright support panel.

FIG. 8 is a rear view of the Utility Bin in home position illustrating the said second alternative configuration of the upright support panel.

FIG. 9 is a perspective rear view of the Bin illustrating an alternative configuration of the lower retainer.

DETAILED DESCRIPTION OF THE INVENTION

Figure 1:
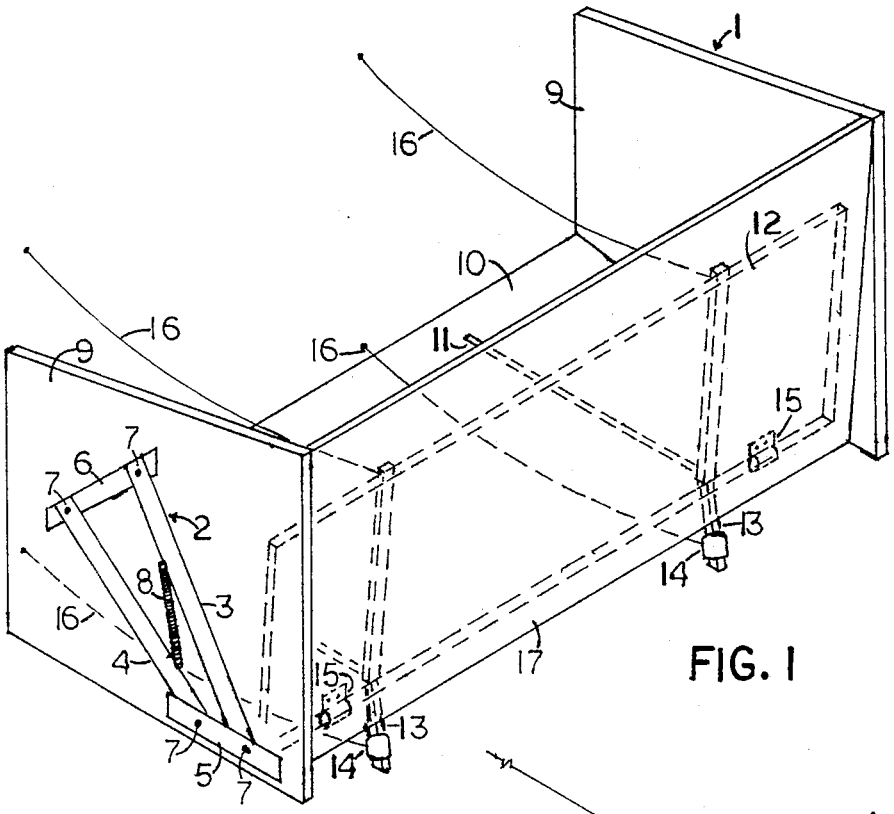
FIG. 1 is a perspective front view of the Utility Bin in the preferred embodiment in home or closed position.
Figure 2:
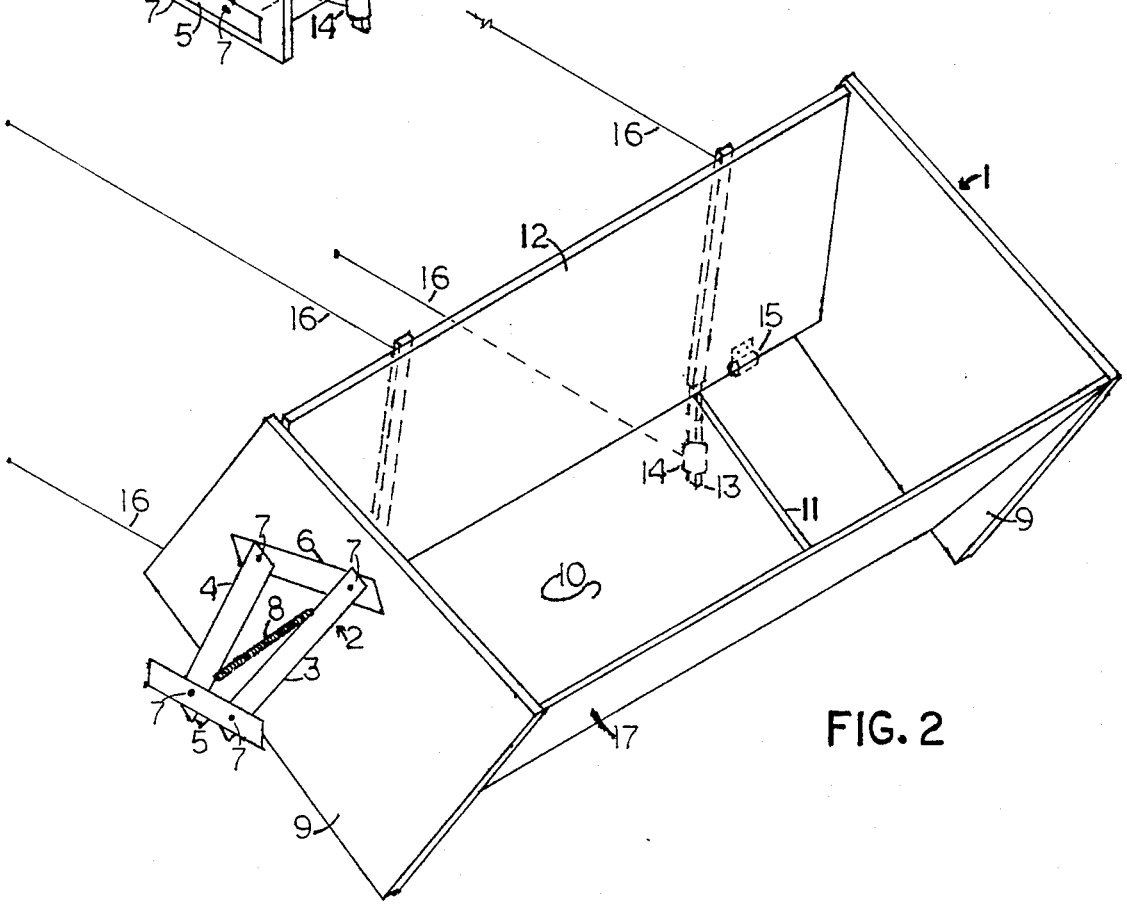
FIG. 2 is a perspective front view of the Utility Bin in the preferred embodiment in access or open position.
Figure 3:
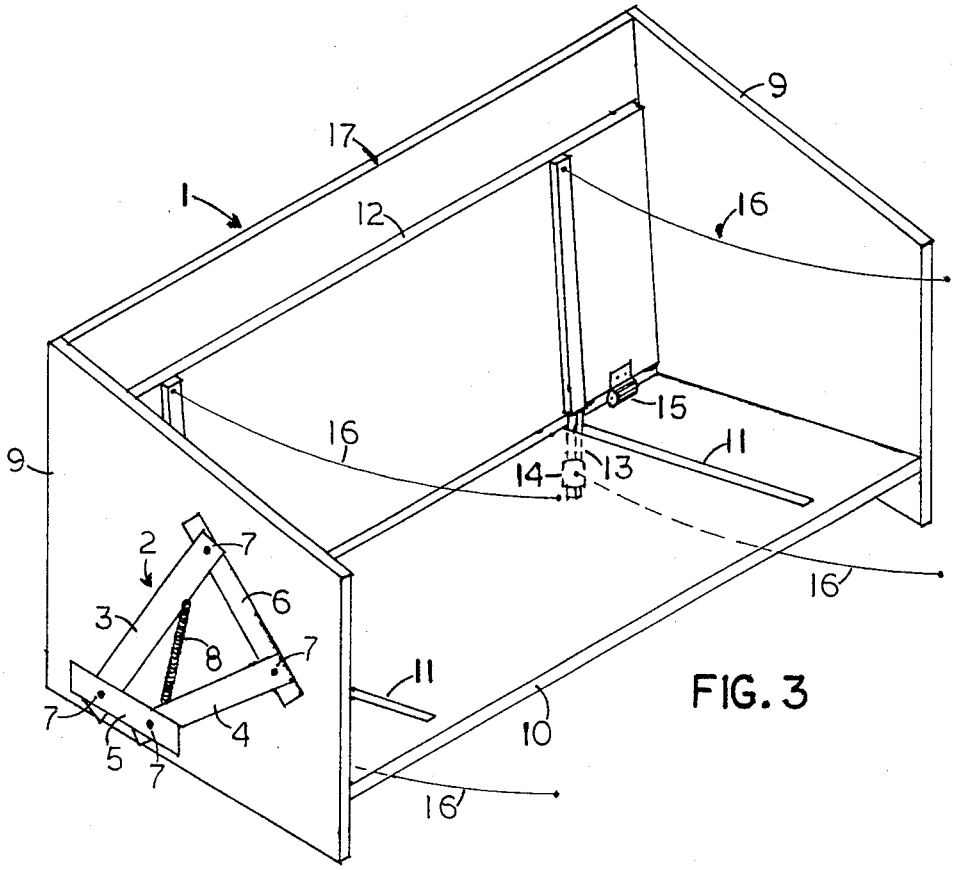
FIG. 3 is a perspective rear view of the Utility Bin in the preferred embodiment in home position.
Figure 4:
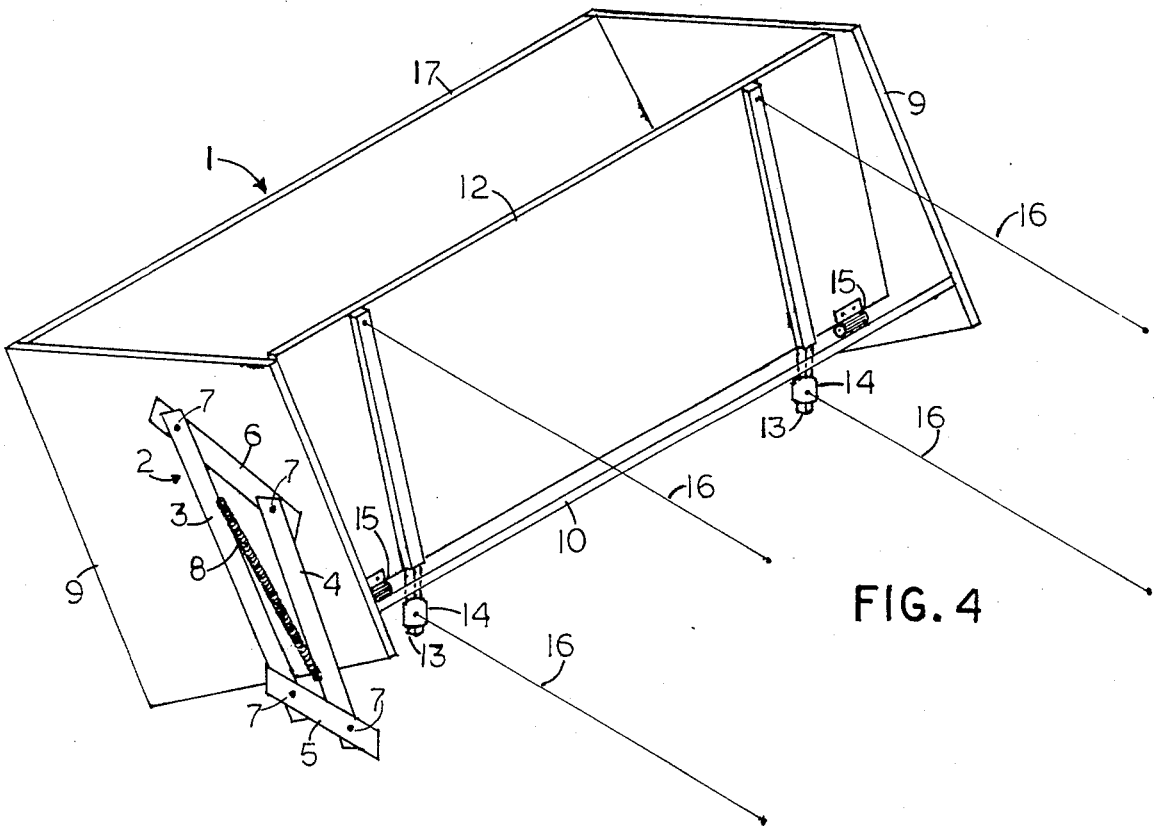
FIG. 4 is a perspective rear view of the Utility Bin in the preferred embodiment in access position.

Referring to the drawings in detail, FIGS. 1, 2, 3, and 4 illustrate the components of the Utility Bin in the preferred embodiment with means to maintain contents such as magazines, newspapers, books, and papers in an upright position.

Pivot means 2, incorporated on each end of the Utility Bin 1, transmit support from an appropriate housing structure such as furniture, a cabinet, or a closet to the Utility Bin 1. The lower plate 5 is fixedly attached to said housing structure. Forward pivot arm 3 and rear pivot arm 4 are pivotally attached at the lower end to lower plate 5, diverge at the upper end and are pivotally attached to upper plate 6. Upper plate 6 is fixedly attached to an end 9. In certain cases where the bin 1 and the said housing structure are constructed of suitable material, the lower plate 5 and the upper plate 6 may be omitted by the forward pivot arm 3 and the rear pivot arm 4 being pivotally attached to end 9 and pivotally attached to the said housing structure.

A spring 8 is connected at one end near the upper end of forward pivot arm 3 and connected at the opposite end near the lower end of rear pivot arm 4 to aid in positioning the bin 1 from access to home position. The spring 8 may be omitted where a particular embodiment of the bin 1 and the said contents are sufficiently lightweight.

The upper edge of end members 9 is sloped downward from front to rear to avoid contact with the said housing structure when the bin is placed in access position.

The bottom 10 is sloped downward from rear to front as means to help counteract the tendency of said upright placed flexible contents to slide away from the front 17, and also as means to assist in effecting forward movement of the automatically positioned upright support panel 12 into contact with said contents.

The automatically positioned upright support panel 12 holds said contents against the front 17 when the bin 1 is placed in home position. Upright support extensions 13 extend at a forward angle through rear to front slots 11 in the bottom 10 to act in conjunction with added weight 14 to provide upright stability of the support panel 12, and in conjunction with rollers 15, and the downward sloping bottom 10 to increase forward pressure between the upright support panel 12 and said contents.

Retainers 16, made of flexible material such as chain, are attached to the upper and lower area of the upright support panel 12 and to a stationary member of said housing structure beyond the rear of the bin 1 as indicated in the drawings, as means of retaining the upright support panel 12 to the rear of the bin 1 when the bin 1 is in access position. The flexibility of the retainers 16 allows the upright support panel 12 to remain as far to the rear of the bin 1 as needed as the support panel 12 makes contact with said contents as the bin 1 is returned to home position.

The front 17 is sloped inward from top to bottom as means to help counteract the tendency of said upright placed contents to tilt or fall toward the rear as the bin 1 is placed in home position. A finised front, not shown, to match the style of the said housing structure, may be added to the exterior of the bin front 17.

FIGS. 5 and 6 illustrate alternative means to effect forward placement and contact of the upright support panel 12 with said contents, with rollers 18 extending from the upper area of the upright support panel 12 into downward sloping rear to front slots 19 in the ends 9.

FIGS. 7 and 8 illustrate a second alternative means to effect forward placement of the upright support panel 12, with rollers 20 extending from the upper area of the upright support panel 12 into downward sloping rear to front tracks 21 added to the ends 9.

FIG. 9 illustrates an alternative routing of the lower flexible retainers 16 as means to increase the distance the lower area of the upright support panel 12 is moved to the rear when the bin 1 is moved to access position, whereas the lower retainers 16 are lifted upward by rollers 25 added to the bottom 10, thereby shortening the forward extendion of the retainers 16.

Figure 10:
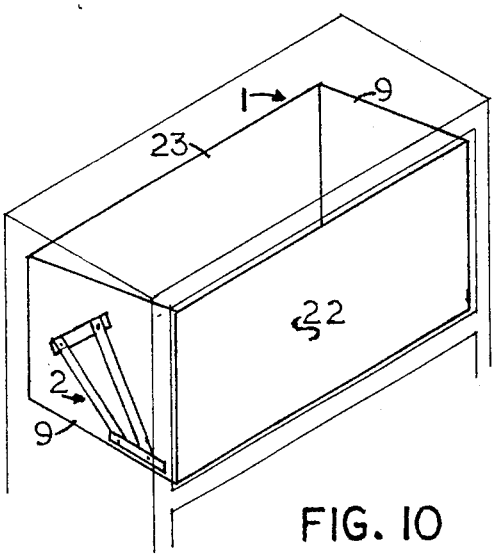
FIG. 10 is a perspective front view of the Utility Bin in a secondary configuration in home position as installed in a piece of furniture.
Figure 11:
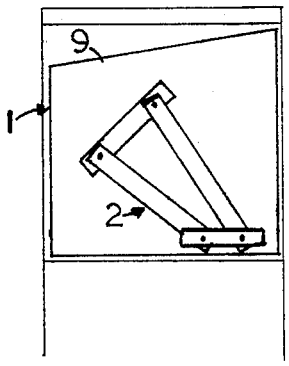
FIG. 11 is an end view of the Utility Bin in the said secondary configuration in home position as installed in a piece of furniture.
Figure 12:
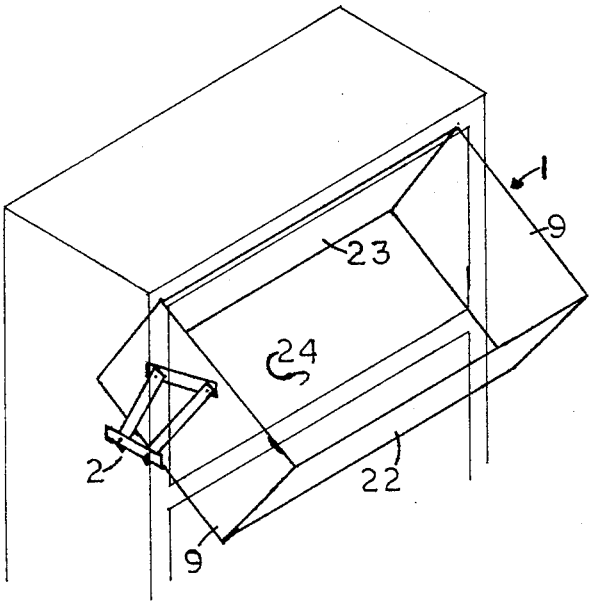
FIG. 12 is a perspective front view of the Utility Bin in the said secondary configuration in access position as installed in a piece of furniture.
Figure 13:
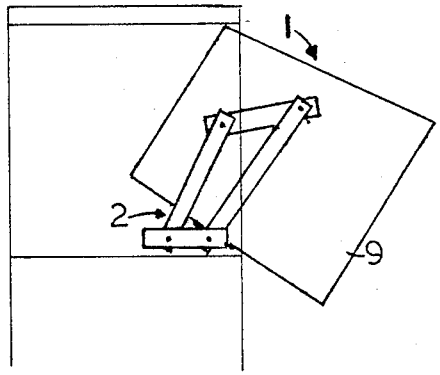
FIG. 13 is an end view of same as FIG. 12.

FIGS. 10, 11, 12, and 13 illustrate a secondary configuration of the Utility Bin with means to provide maximum access to non-upright placed contents such as wearing apparel and linen. The front 22, the back 23, and the bottom 24 require no slope. The ends 9 and the pivot means 2 are the same as in the said preferred embodiment.

The disclosure of the invention described hereinabove represents the preferred embodiments of the invention, however variations thereof, in the form, construction, and arrangement of the various components thereof and the modified application of the invention are possible without departing from the spirit and scope of the appended claims. Other possible variations, for example, include: as storage for videl and audio cassetts, as automobile tilt out glove compartment, as trash container, and as storage for vegetables such as onions and potatoes.

We claim:

1. An improved utility bin of the type having a front member, a rear member, a bottom member, a left side member and a right side member, all interconnected to form a compartment therein, for use within a containment structure such as a cabinet, comprising:

(a) a flat, rigid, rectangular non-vertical front member having an inward sloped alignment from front member top to front member bottom;

(b) a flat, rigid, rectangular non-horizontal bottom member, having a front edge rigidly securred to a bottom edge of said front member, said bottom member having a sloped alignment with its front edge being at a lower elevation than its rear edge;

(c) a flat, rigid, vertical left side member rigidly securred to a left edge of said front member and rigidly securred tp a left edge of said bottom member, said left side member having a straight horizontal bottom edge, a straight vertical front edge, a straight vertical rear edge, and a straight nonhorizontal top edge, with said vertical front edge being slightly longer than said vertical rear edge;

(d) a flat, rigid, vertical right side member rigidly securred to a right edge of said front member and rigidly securred to a right edge of said bottom member, said right side member having a straight, horizontal bottom edge, a straight vertical front edge, a straight vertical rear edge, and a straight, non-horizontal top edge, with said vertical front edge being slightly longer than said vertical rear edge;

(e) pivoting means for pivoting said front member, said bottom member, said left side member and said right side member out of said containment structure in unison, further comprising; a first, elongated, rigid lower plate securred in horizontal alignment to a left side portion of said containment structure; a second, elongated, rigid lower plate securred in horizontal alignment to a right side portion of said containment structure; a first, elongated, rigid upper plate securred to the outer surface of said left side member in non-horizontal alignment with its rearward edge being lower than its forward edge; a second, elongated, rigid upper plate securred to the outer surface of said right side member in non-horizontal alignment with its rearward edge being lower than its forward edge; a rigid, elongated first pivot arm, pivotally securred to a rearward portion of said first lower plate and pivotally securred to a rearward portion of said first upper plate; a second, rigid, elongated, pivot arm, longer than said first pivot arm, pivotally securred to a frontward portion of said first lower plate and pivotally securred to a frontward portion of said first upper plate; a third, rigid, elongated pivot arm, similar to said first pivot arm, pivotally securred to a rearward portion of said second lower plate and pivotally securred to a rearward portion of said second upper plate; a fourth rigid elogated pivot arm, similar to said second pivot arm, pivotally securred to a frontward portion of said second lower plate and pivotally securred to a frontward portion of said second upper plate; a first tension spring interconnecting said first pivot arm and said second pivot arm; and a second tension spring interconnecting said third pivot arm and said fourth pivot arm;

(f) a flat, rigid, rectangular vertical rear member movably positioned between said left side member and said right side member, having two or more rollers securred to its bottom edge for movably contacting the top surface of said bottom member; and (g) a plurality of flexible strands, each strand having a first end securred to said containment structure and a second end securred to said rear member.

2. The apparatus of claim 1 wherein one or more elongated slots are inscribed through said bottom member from near its front edge to near its rear edge, an equal number of support extensions rigidly projecting from the bottom edge of said rear member, each support extension penetrating a corresponding one of said slots; and a flexible strand connecting each support extension to said containment structure.

3. The apparatus of claim 2 comprising a weighted device securred to the bottom of each support extension.

4. The apparatus of claim 3 wherein a bearing means extends outward from near each top outer corner of said rear member into contact with a horizontal surface formed on the interiors of said left side member and said right side member, thereby providing for support of the top portion of said rear member.

* * * * *